US008269646B2

(12) United States Patent
Exman

(10) Patent No.: US 8,269,646 B2
(45) Date of Patent: Sep. 18, 2012

(54) AUDIO DRIVEN SYNCHRONIZED LIGHT DISPLAY

(76) Inventor: Robert Francis Exman, Woodstock, OH (US)

( * ) Notice: Subject to any disclaimer, the term of this patent is extended or adjusted under 35 U.S.C. 154(b) by 508 days.

(21) Appl. No.: 12/609,013

(22) Filed: Oct. 30, 2009

(65) Prior Publication Data

US 2011/0102187 A1 May 5, 2011

(51) Int. Cl.
*G08B 5/22* (2006.01)
*A63J 17/00* (2006.01)

(52) U.S. Cl. ..... 340/815.45; 340/815.46; 345/46; 362/800; 84/464 R; 381/58

(58) Field of Classification Search ..... 340/815.45, 340/815.46; 84/464 R
See application file for complete search history.

(56) References Cited

U.S. PATENT DOCUMENTS 6,166,496 A * 12/2000 Lys et al. ..... 315/316
7,228,190 B2 * 6/2007 Dowling et al. ..... 700/94
7,459,623 B2 * 12/2008 Robertson ..... 84/464 R
7,754,960 B2 * 7/2010 Yamamoto et al. ..... 84/645

* cited by examiner

*Primary Examiner* — Donnie Crosland
(74) *Attorney, Agent, or Firm* — Oakwood Law Group, llp; Yuchien Wei; Stephen Liu

(57) ABSTRACT

Disclosed is a light display comprised of a light display unit containing 24 LEDs of various colors, a USB connector connecting the light display unit to a computer, and light display custom software that is loaded onto the computer. When the computer plays music audio such as a WAV file, MP3 file, or a CD disk, the light display custom software, installed on the computer, transforms the audio output into a four 8-bit byte record 40 times a second. The first byte is a header record, and the remaining 3 bytes contain 24 instruction bits. The instruction bits are calculated using a programmed spectrum analyzer that filter the sampled audio signal over a range of 20 Hz to 20K Hz. When the frequencies within a given band exceeds a threshold, the bit associated with that band is set to 1, otherwise the bit is set to 0. The light display unit contains a circuit board that turns the LED associated with the bit on if the bit is one, otherwise it is turned off.

7 Claims, 5 Drawing Sheets

AUDIO DRIVEN SYNCHRONIZED LIGHT DISPLAY

CROSS-REFERENCE TO RELATED APPLICATIONS

None

TECHNICAL FIELD

The invention presented herein relates to light displays; more particularly to light displays that are driven by audio generated from a computer-hosted media player.

BACKGROUND OF THE DISCLOSURE

There exist many products that present music driven light shows involving a group of lights flashing on and off. Many of these products are high end equipment used by nightclubs, dance studios, etc. The flashing lights of these products are synchronized with the music, so they has a pleasing effect on the audience.

However, it would be desirable for a person to have a system that provides a light show synchronized with music that may be played on his or her own personal computer. Such a system should be inexpensive to manufacture, have a customizable display that may be placed on a tabletop such as a desktop, and be easily installed and used with the person's personal computer.

SUMMARY OF THE DISCLOSURE

This invention addresses the needs indicated above by providing a light display unit that may be placed on a desktop, is driven by software installed on a desktop computer or laptop, and provides a light show that is synchronized with music played on the computer. In the embodiment presented herein, a 24 LED (light emitting diode) light display unit sits on a desk or table and is attached via a standard USB (universal serial bus) port to a host computer. The computer contains light display custom software that receives from a computer-hosted media player a real-time audio stream sampled at 40 times a second, and transforms these audio samples into a byte stream that provides instructions to the light display unit to turn the LEDs on or off in a manner synchronized with the audio 40 times a second. The media player receives its input from a source such as a WAV file, MP3 file, or a CD disk, The embodiment functions as follows. The light display custom software receives the audio stream, samples it 40 times a second, and in real time transforms the stream into a four 8-bit byte record for each sample. The software implements a 28 band digital frequency analyzer that functions with a frequency range of 20 Hz to 20K Hz. The software partitions this frequency range into 28 distinct bands; 24 of the bands are each associated with a distinct LED on the light display unit. The four-byte record is created as follows. The first byte is an address marker indicating that the next three bytes contain the LED ON/OFF instructions, one bit for each LED. The bits are set to 1 (ON) or 0 (OFF) for each band depending on whether the frequency analyzer determines that the power of the frequencies within the band lie above a threshold specified for that band.

The four-byte record is sent via a USB cable to a circuit board mounted in the light display unit. The circuit board converts each data bit (0 or 1) associated with a given LED into instructions for turning on or off the LED assigned to that bit. Since the bit values are coordinated with the music audio output, the lights flash in synchronization with the music, providing a pleasing and entertaining effect.

The light display unit may be manufactured inexpensively, display the LEDs in a custom configuration, customize the individual LED colors, and include additional indicia on the display unit such as a heart or a flag.

LIST OF FIGURES

DETAILED DESCRIPTION OF THE DISCLOSURE

Figure 1:
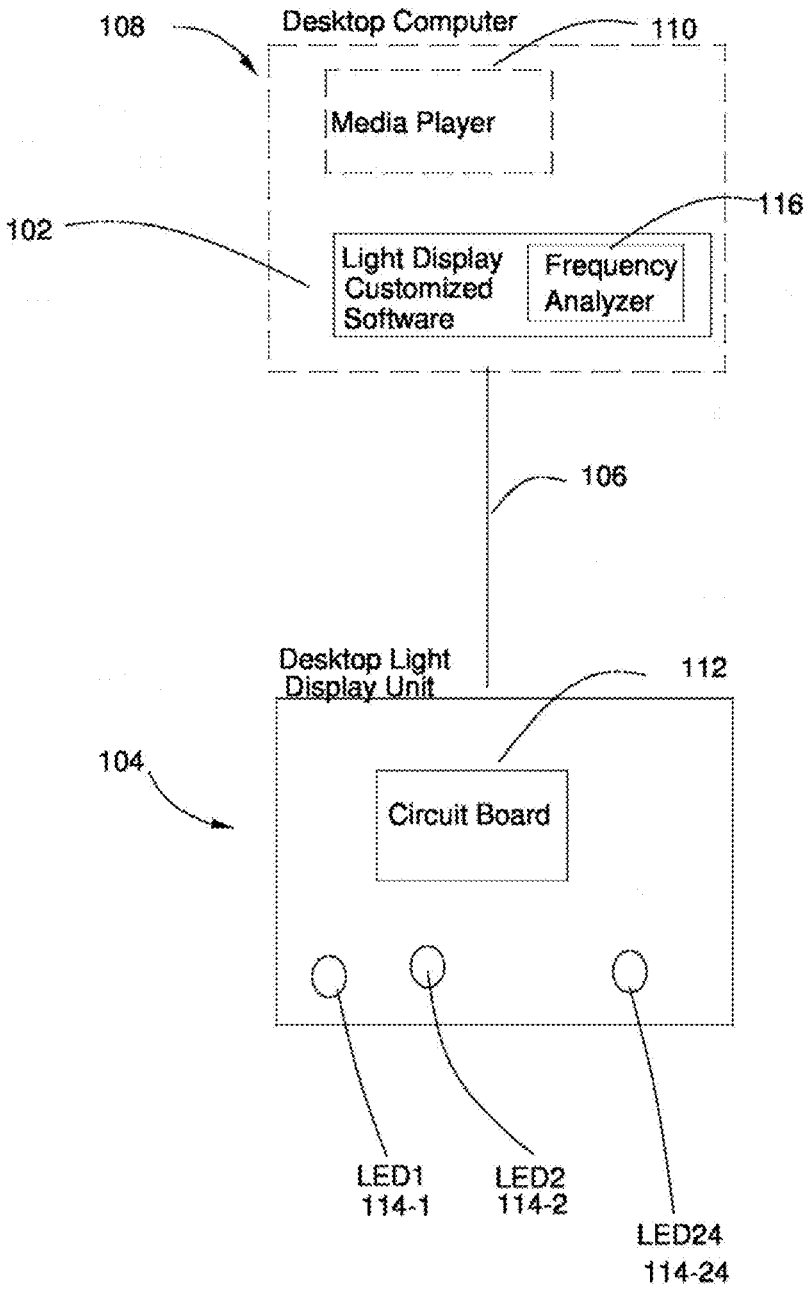
FIG. 1 is a block diagram illustrating the components of the embodiment.

FIG. 1 illustrates the components of an embodiment of the invention and its use with a host computer having a media player. The embodiment is a system comprised of custom light display software 102, a light display unit 104 containing 24 LEDs, and a USB cable 106. The custom light display software 102 is installed in a host computer 108. The custom light display software 102 receives input audio streams from a media player 110 implemented in the host computer 108, and transforms the input frequency signals, sampled 40 times a second, into an output stream of four 8-bit byte records, one bit in each the last three bytes of a record assigned to one of the 24 LEDs.

The embodiment functions as follows. The light display custom software 102 receives the audio stream and in real time transforms the stream into four 8-bit byte records 40 times a second. The software implements a frequency analyzer 116 that has a frequency range of 20 Hz to 20K Hz. The frequency analyzer 116 partitions this frequency range into 28 distinct bands. 24 of the bands are selected; each band associated with a distinct LED on the light display unit. The four-byte record is created as follows. The first byte is an address marker indicating that the next three bytes contain the LED ON/OFF instructions, one bit for each LED. The bits are set to 1 (ON) or 0 (OFF) for each band depending on whether the frequency analyzer 116 determines that the power of the frequencies within the band lie above a threshold specified for that band.

The power thresholds T (i), i=1 through 24, and the selection of the 24 bands are design parameters. In the embodiment presented herein, the two lowest frequency and two highest frequency bands (band (1), band(2), band(27), band(28)) are excluded and the remaining 24 bands (band(3) through band (26)) are assigned to LED(i), i=1 through 24 using the mapping: band(i+2) is assigned to LED(i). The power thresholds T(i) are determined by experimentation. In this embodiment, the threshold is set to half the maximum expected power received in the band.

The four-byte records are sent to a circuit board 112 located in the light display unit 104. The light display unit 104 has 24 LEDs (denoted by 214-1 through 214-24 in FIG. 1). Each LED **214-*i* is connected to the circuit board 112 and assigned to a distinct bit in the last 3 bytes. If the bit associated with a particular LED in a particular sample has an ON indicator, i.e. it is set to 1, the circuit board 112** lights the associated LED; otherwise the LED is not lit.

Figure 2:
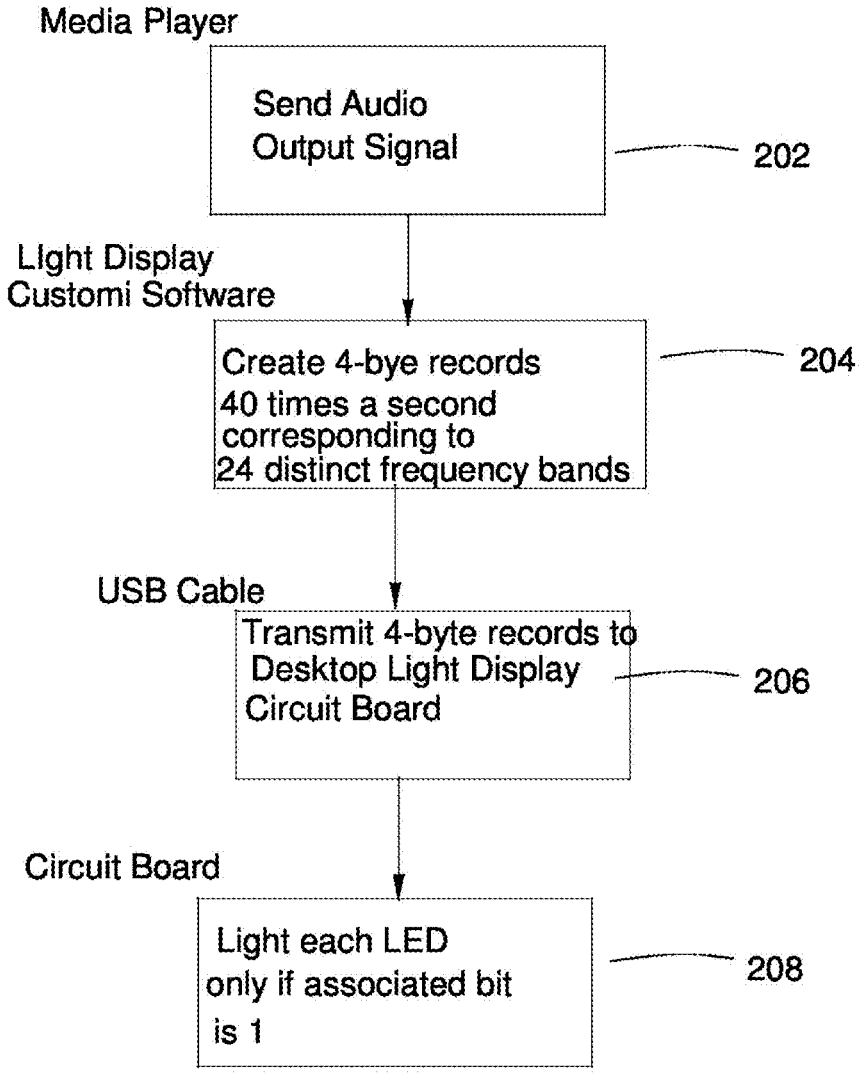
FIG. 2 is a flow diagram showing the processing of the various elements of the embodiment.

FIG. 2 illustrates the processing of the embodiment. Referring to FIG. 2, the media player 202 continually transmits an audio stream to the light display custom software 204. The custom light display software 204, using a software implemented digital frequency analyzer, converts the input stream, sampled at 40 sampled a second, into twenty-eight distinct frequency bands over the frequency interval 20 Hz to 20K Hz. The software selects 24 of the 28 bands, and assigns each of the 24 selected bands to a distinct LED. The light display software 204 then converts the output of the frequency analyzer to four 8-bit bytes. The first byte is an address marker indicating that the next three bytes contain either a 0 or a one that translates into the LED ON/OFF instructions for each LED.

The four-byte records are then transmitted via the USB cable 206 to circuit board 208 40 times a second. The circuit board 208 processes each four-byte record, and depending on the instructions in each bit of the last three bytes, turns the associated LED either on or off.

Figure 3:
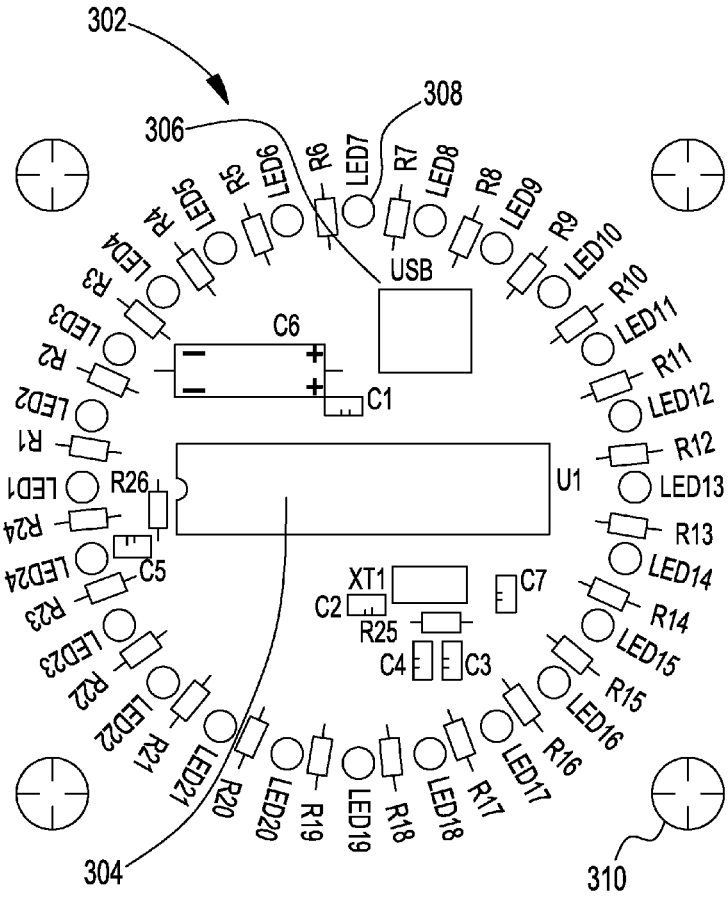
FIG. 3 illustrates the components on the circuit boards of the embodiment.

FIG. 3 illustrates the components 302 positioned on the circuit board 302 where the LEDs are configured in a circular display. Table 1 gives the symbols and the electronic component correspondent to the symbol located on the circuit board. The microprocessor U1 is a Microchip Technology processor P1C18F4550 IC chip 304. The chip has on board a USB interface J1 306 along with more than 24 I/O pins (not shown in the Figure). The 24 LEDs 308 are connected to the chip's I/O pins and the chip is programmed to receive data from the host computer via the USB interface J1 306. Connector holes 310 are used to connect the circuit board 302 to the display unit case. Table 1 illustrates the symbols and part numbers shown in FIG. 3.

TABLE 1

| Symbol | Part Number |
|---|---|
| U1 | Microchip PXC18F4550 8 Bit Microprocessor |
| R1-R24 | IK Ohm Resistor ¼ Watt 5% |
| R25 | 1M ohm Resistor ¼ Watt 5% |
| R26 | 10K ohm Resistor ¼ watt 5% |
| C1, C2, C5 | 0.1 UF Capacitor 25 WV |
| C3, C4 | 22 PF capacitor 25 Wv |
| C6 | 1 UF Capacitor 25 Wv |
| C7 | 470 PF Capacitor 25 Wv |
| xT1 | 20 Mhz crystal |
| J1 | USB Connector B Type, vertical EDAC INC. 690-004-260-023 |
| LED1-24 | 5 MM T1-¾ LED of various colors |

Figure 4:
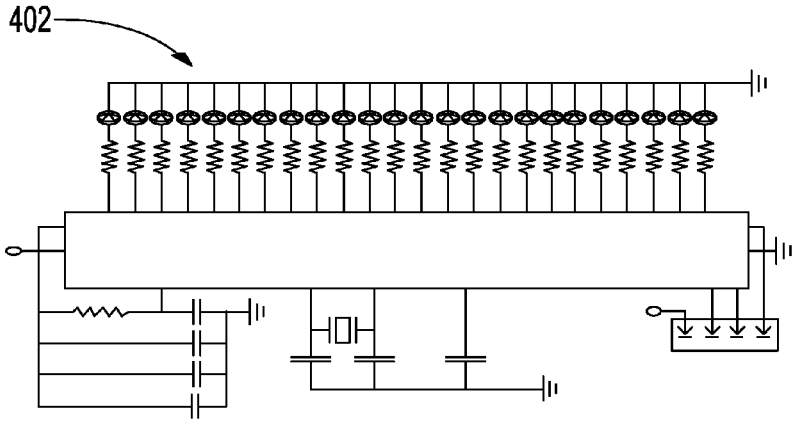
FIG. 4 illustrates the circuit board wiring diagram on the light display unit the embodiment.

FIG. 4 illustrates a circuit diagram 402 for the components on the circuit board. The symbols in Table 1 apply to FIG. 4 also.

Figure 5:
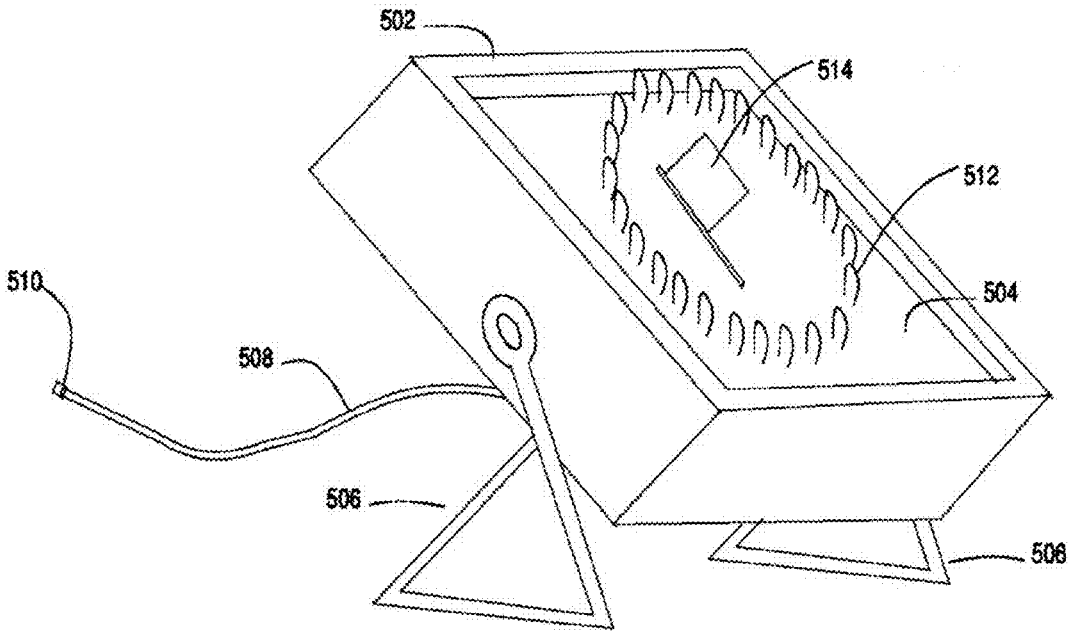
FIG. 5 illustrates the components of the light display unit of the embodiment.

FIG. 5 illustrates the light display unit. It consists of a case 502, the circuit board 504 mounted in the case 502, a stand 506, and the USB cable 508 with the USB connector 510. The circuit board has the 24 LEDs 512. Indicia 514 may be included on the light display unit and may be customized; for example displaying a heart indicating Valentines' day or a flag indicating patriotism.

To use the device, the custom light display software is loaded onto the host computer, and the USB connector of the light display unit is attached to the USB computer hub on the host computer. When the user plays a song on the media player, the light display unit turns on and off each LED based on the frequency bands present in the song. Some LEDS will flash with the bass while other will flash with the mid range and others with flash with the high frequencies.

The disclosure presented herein gives an embodiment of the invention. This embodiment is to be considered as only illustrative of the invention and not a limitation of the scope of the invention. Various permutations, combinations, variations and extensions of this embodiment are considered to fall within the scope of this invention. Therefore the scope of this invention should be determined with reference to the claims and not just by the embodiment presented herein.

What is claimed is:

1. An system for displaying LED lights synchronized with media player audio output comprising:

24 LEDs;

custom software, that when installed on a host computer, being capable of transforming media player audio output sampled 40 times a second, wherein each sample being transformed into a four 8-bit byte record, the first byte indicating that the next three bytes are instructions to the LEDs, each bit in the last three bytes being assigned to a distinct LED;

a means for turning each LED on if the bit assigned to the LED is 1 and turning it off otherwise.

2. The system of claim 1 further comprising a circuit board hosting the LEDs and additionally further comprising circuitry that for each four 8-bit byte record received, turns each LED on if the bit assigned to the LED is has value 1, otherwise turning it off.

3. The system of claim 1 further comprising a digital frequency analyzer implemented in the custom software wherein the digital frequency analyzer partitions the frequency analyzer processing into 28 frequency bands over the range 20 Hz to 20K Hz, and additionally assigns 24 or the 28 bands to the 24 LEDs, each band assigned to a distinct LED, assigns each bit in the last 3 bytes to a distinct LED, and assigning the value of the bit to 1 if the power in the band determined from a sample of the output of a media player is above a threshold, and 0 otherwise.

4. The circuit board of claim 2 further comprising a PXC18F4550 8 Bit Microprocessor.

5. The circuit board of claim 2 being installed on a desktop display that is customized with indicia representing a particular theme such as a heart indicating Valentines' day or a flag indicating patriotism.

6. The method of displaying a light show synchronized with audio output comprising:

sampling audio output 40 times a second;

applying a digital frequency analyzer with a range of 20 Hz to 20K Hz and partitioning the range into 28 frequency bands, applying the frequency analyzer to each audio sample, and calculating power levels of the sampled audio associated with each of the bands;

selecting 24 of the 28 bands, assigning to each of the selected bands a threshold and assigning a 1 to the band if the power level of the output associated with the band lies above the threshold and 0 otherwise when the frequency analyzer processes a sample of the audio;

transforming the bits outputted by each band of the 24 selected bands to a four 8-bit byte record, wherein the first bye indicates that the next three bytes are instructions, and each bit in the next three bytes being an indicator whether to turn an LED on or off;

transmitting the four 8-bit bytes to a circuit board on a desktop display, the circuit board turning on each of 24 LEDs mounted on the circuit board if the bit assigned to the LED is 1 and turning the LED off otherwise.

7. The method of claim 6 wherein the circuit board is mounted on a desktop display.

* * * * *